US005738241A

United States Patent [19]

McEntee

[11] Patent Number: 5,738,241

[45] Date of Patent: Apr. 14, 1998

[54] MULTI-PURPOSE COMPARTMENTALIZED CRAFT BOX

[75] Inventor: Kathryn M. McEntee, Washington, N.C.

[73] Assignee: Zeta Consumer Products Corp., Little Falls, N.J.

[21] Appl. No.: 600,395

[22] Filed: Feb. 12, 1996

[51] Int. Cl.[6] ..... B65D 1/24

[52] U.S. Cl. ..... 220/532; 220/533; 220/505; 206/508; 206/373

[58] Field of Search ..... 220/505, 23.83, 220/23.86, 533, 532, DIG. 13; 206/372, 373, 508

[56] References Cited

U.S. PATENT DOCUMENTS

| | | | |
|---|---|---|---|
| 757,645 | 4/1904 | Bassett | 220/DIG. 13 |
| 3,909,092 | 9/1975 | Kiernan | 220/505 |
| 4,504,000 | 3/1985 | Doyel . | |
| 5,004,103 | 4/1991 | Connors et al. . | |
| 5,069,342 | 12/1991 | Dickinson . | |
| 5,297,674 | 3/1994 | Birutis et al. | 220/23.83 |
| 5,299,688 | 4/1994 | McKay et al. | 220/533 |
| 5,392,945 | 2/1995 | Syrek | 206/508 |
| 5,441,707 | 8/1995 | Lewis et al. | 220/23.86 |

*Primary Examiner*—Stephen J. Castellano
*Attorney, Agent, or Firm*—Chadbourne & Parke LLP

[57] ABSTRACT

A substantially rectangular multi-purpose craft comprising a outwardly extending, convexly-curved front and back walls, and side walls, the front, back and side walls surrounding a main compartment, a front tray which extends outwards from the upper portion of the front wall, and a contoured lid to cover the multipurpose craft box. The main compartment contains a plurality of opposing grooves for receiving a partition so that the main compartment may be subdivided into smaller compartments. A shoulder runs along the inside surfaces of the front and back walls forming a resting surface for supporting a container. The front tray is divided into a plurality of compartments. Opposing slots located in the inner walls of the compartments for receiving dividers allows a user to further subdivide each front tray compartment.

9 Claims, 5 Drawing Sheets

FIG. 4
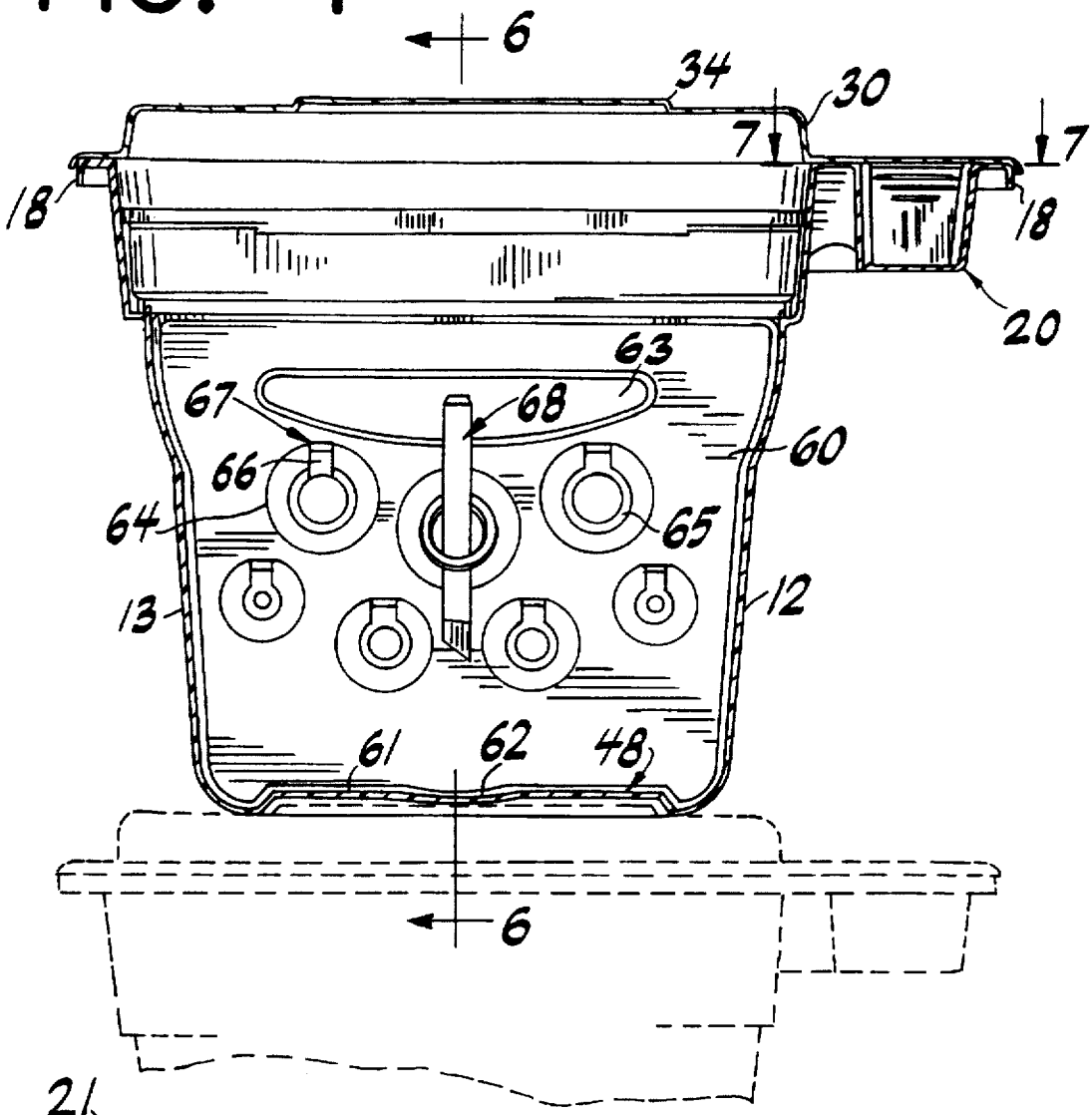
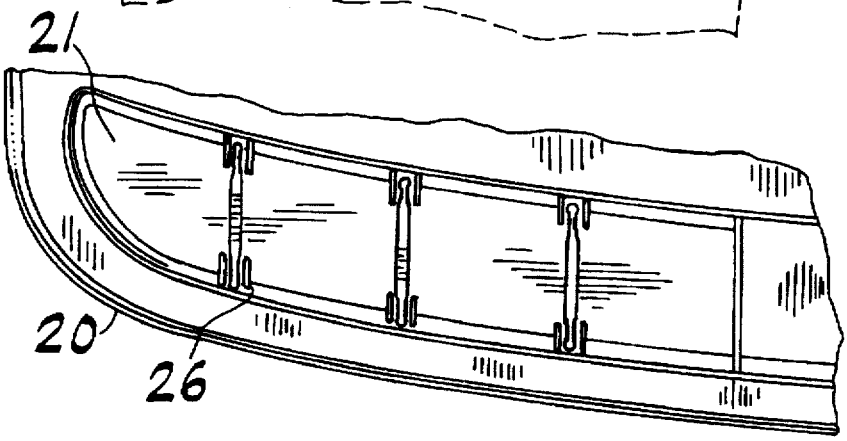
FIG. 7

FIG. 5
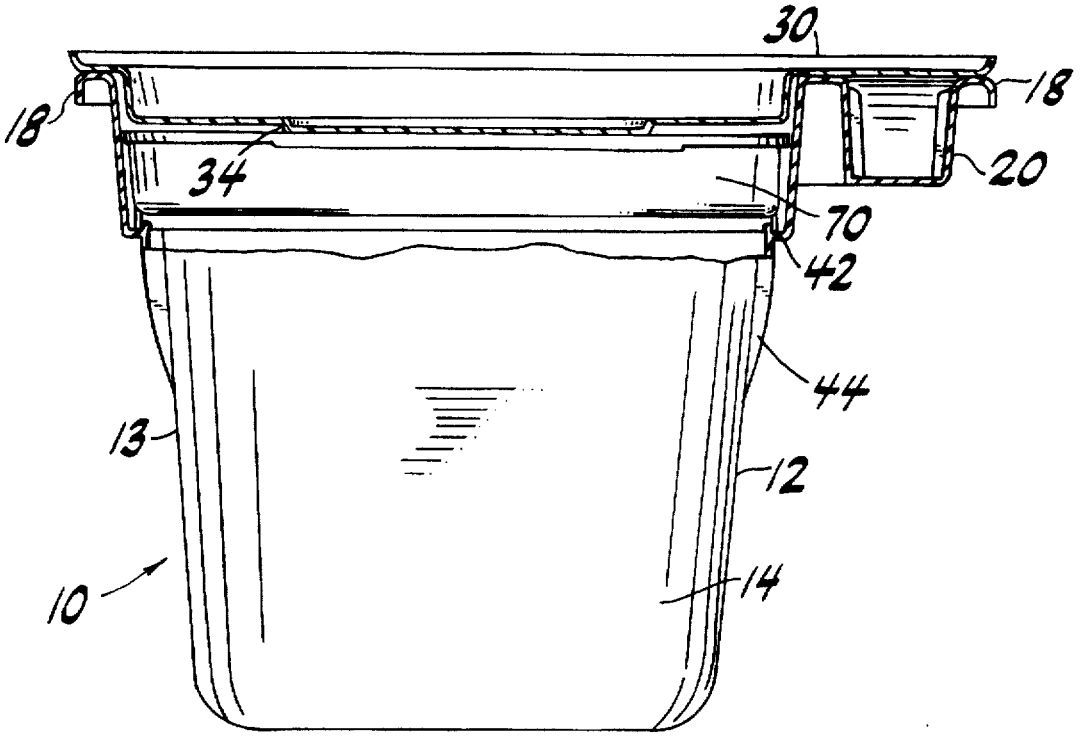
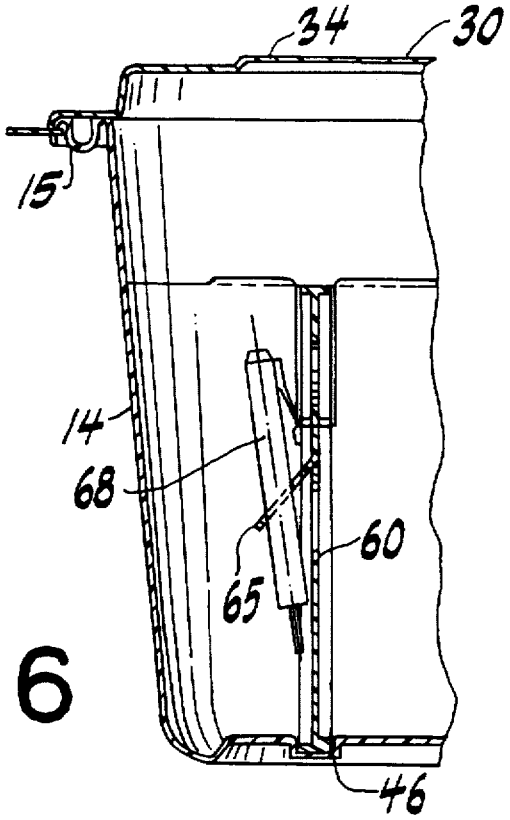
FIG. 6

MULTI-PURPOSE COMPARTMENTALIZED CRAFT BOX

This invention relates to craft box and, more particularly, to a combined multi-purpose carrying container and work surface.

BACKGROUND OF THE INVENTION

Tool boxes and sewing boxes are known in the art, as evidenced by the numerous patents directed towards this subject matter. However, the prior art has concentrated on providing improvements to singular-purpose boxes, be they tool boxes, or sewing boxes. For example, U.S. Pat. No. 5,069,342 issued on Dec. 3, 1991 to Dickinson discloses a combination tool box and organizer containing a set of storage compartments which may be locked into a closed position while the tool box is being transported over long distances.

Likewise, U.S. Pat. No. 5,004,103 issued on Apr. 2, 1991 to Connors discloses a storage and tote box for tools. However, unlike the tool box disclosed in the '342 patent to Dickinson which was directed towards tools in general, the '103 patent is specifically directed towards punches and dies for the production of pharmaceutical tablets and caplets. The Connors tool box contains a plurality of trays which are adapted to hold the various dies and punches in an interlocking position when the tool box is closed.

U.S. Pat. No. 4,504,000 issued Mar. 12, 1985 to Doyel discloses a sewing box. The Doyel sewing box is particularly adapted to store a wide variety of sewing accessories.

It would be desirable to have a box that would serve to hold a variety of different tools and utensils, as well as any supporting equipment.

SUMMARY OF THE INVENTION

The present invention is directed towards providing a multi-purpose craft box that may readily be adapted for use with a wide variety of craft projects, for example, a sewing box for sewing projects; a ceramics box for ceramics projects; a paint box for painting projects; or even a doll-making box for doll-making projects. The multi-purpose craft box comprises a substantially rectangular-shaped box having convexly-curved front and back walls and a front tray protruding outwards from the upper portion of the front wall. The front tray is divided into first and second compartments separated by a shallow middle compartment. The first and/or second compartment may be adapted to receive small dividers in order to further subdivide either compartment. A contoured lid snaps over the multi-purpose craft box. When turned over, the lid fits inside the multi-purpose craft box and serves as a "roll top" work surface.

The inside of the craft box comprises a main compartment which may be subdivided into a plurality of smaller compartments by one or more partitions. Each partition may be inserted into one of a plurality of grooves on opposing inner walls of the main compartment. Towards the upper portion on the main compartment, the inner surfaces of the front and back wall are molded so as to form a shoulder. This shoulder acts as a resting surface upon which a container may be placed.

According to one aspect of the invention, the partition contains a plurality of circular cut-outs which are designed to hold a variety of objects, for example, tools, writing utensils, or paint brushes.

BRIEF DESCRIPTION OF THE DRAWINGS

The foregoing and other features of the present invention will be more readily apparent from the following detailed description and drawings of a preferred embodiment of the invention in which:

FIG. 1 is an upper perspective view of a preferred embodiment of the multi-purpose craft box with the lid on;

FIG. 4 is a sectional view taken along the line 4—4 of FIG. 1, illustrating a partition, and further showing the stackable feature of the multi-purpose craft box;

FIG. 5 is a left elevational view thereof, the top portion being cut away to show the lid serving as a work surface;

FIG. 6 is a sectional view taken along the line 6—6 of FIG. 4;

FIG. 7 is a view taken substantially along the line 7—7 of FIG. 4, showing a plan view of the front tray.

DETAILED DESCRIPTION OF AN ILLUSTRATIVE EMBODIMENT

Figure 1:
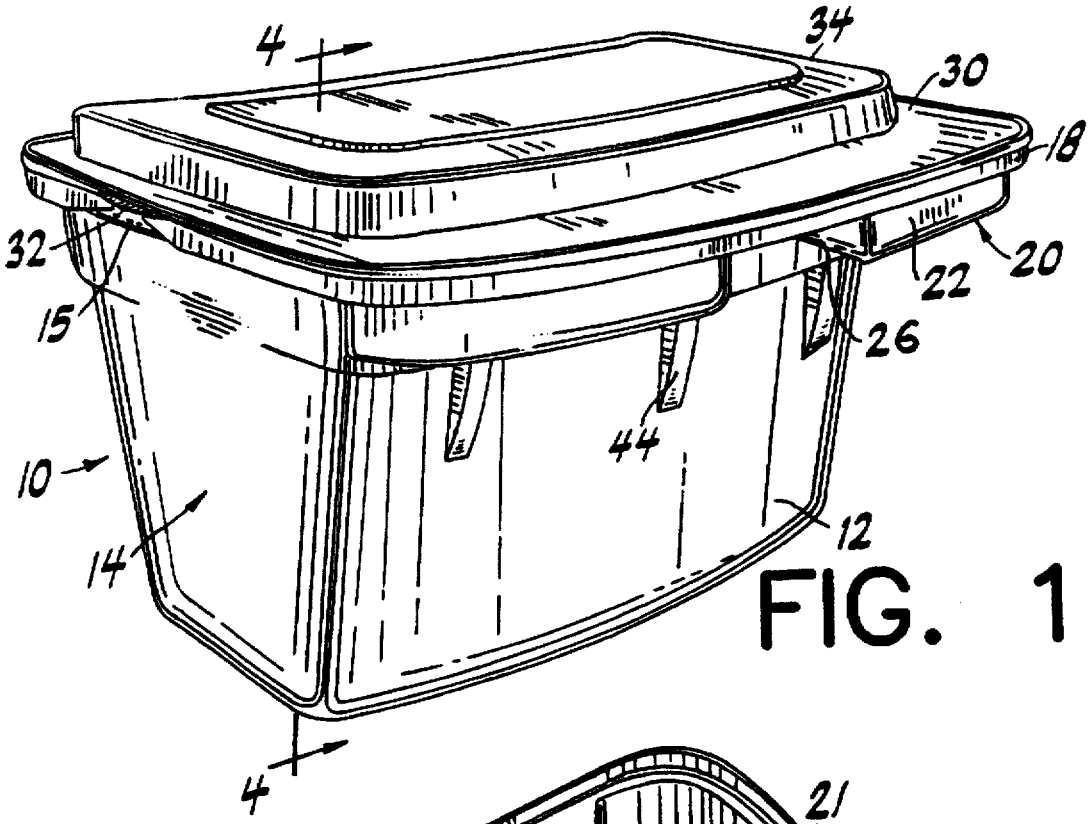
Figure 2:
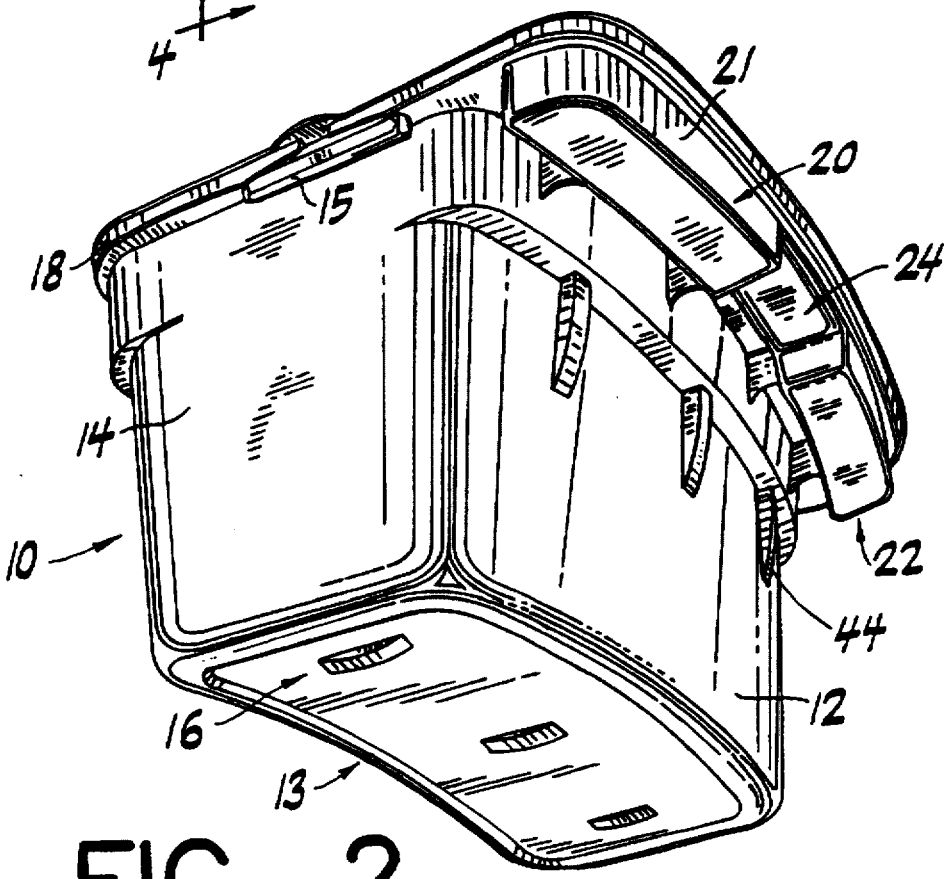
FIG. 2 is a lower perspective view thereof.

FIGS. 1 and 2 illustrate a preferred embodiment of a multi-purpose craft box 10. As shown in FIGS. 1 and 2 the multi-purpose craft box 10 is substantially rectangular having outwardly extending front, back and identical side walls, 12, 13 and 14, respectively. The front wall 12 and the back wall 13 are slightly convexly-curved to facilitate carrying the multi-purpose craft box 10 against a user's hip. As shown in FIG. 2, a gripping handle 15 is preferably molded at the central portion of the top of each side walls 14. The top surfaces of the front, back and side walls, 12, 13, and 14, respectively, curve outwards and then downwards to form a lip 18. A front tray 20 extends from the upper portion of the front wall 12 of the multi-purpose craft box 10. Also shown in FIG. 1, the multi-purpose craft box 10 has a contoured lid 30 which is adapted to snap onto the lip 18 around the top surface of the multi-purpose craft box 10. The lid 30 will be discussed in greater detail in reference to FIG. 3.

The bottom 16 of the multi-purpose craft box 10 has a central indentation which corresponds in depth to the height of the stepped plateau of the lid 30 and, thereby facilitates stacking multi-purpose craft box's, one on top of another. This central indentation appears as a raised floor portion 17 when viewed from the inside of the multi-purpose craft box 10 (FIG. 4).

Figure 3:
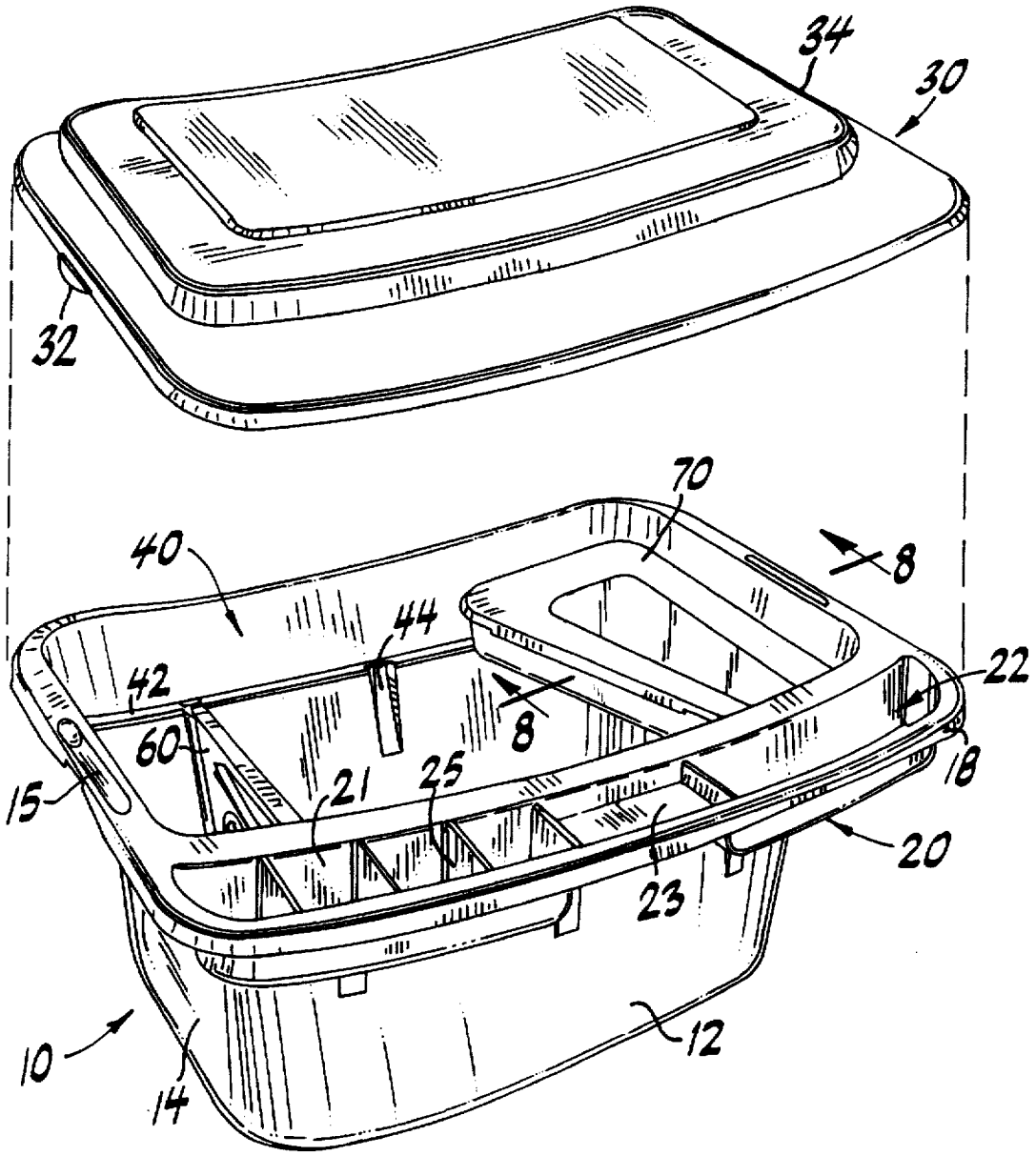
FIG. 3 is a perspective view thereof, having the lid removed to show the internal features.

FIG. 3 shows the multi-purpose craft box 10 with its lid 30 removed. As shown in FIG. 3, the multi-purpose craft box 10 contains the front tray 20 which is partitioned in a plurality of smaller compartments, and a main compartment 40. The front tray 20 extends outwards from the upper portion of the front wall 12 and runs along the entire length thereof. The top surface of the front tray 20 is flush with the top surface 18 of the multi-purpose craft box 10. The front tray 20 is divided into first and second compartments, 21 and 22, respectively, separated by a shallow middle compartment 23. The first and second compartments, 21 and 22, preferably contain dividers 25 which may be inserted into slots 26 to further sub-divide these compartments as required (FIG. 7). The slots 26 are uniformly spaced apart from each other. The floor of the middle compartment 23 of the front tray 20 is raised making the middle compartment 23 shallower than the first and second compartments, 21 and 22. This raised portion forms a gripping surface 24 for gripping the craft box as it is being carried against a user's hip. The compartments of the front tray 20 may be used to keep smaller tools and supplies organized and within easy reach.

As shown in FIG. 3, the main compartment 40 provides the primary storage and work area for the multi-purpose craft box 10. Opposing ledges 42 of equal height are formed towards the upper portion of the inner surfaces of the front and back walls 12 and 13, respectfully. These ledges 42 form a resting surface upon which a variety of containers may be placed. A plurality of opposing grooves 44 are formed in the ledges 42 of the inner surfaces of the front wall 12 and the back wall 13. These grooves 44 are spaced uniformly along the length of the ledge 42. Corresponding to each groove 44, are slight depressions 46 formed in the raised floor portion 48 of the main compartment 40 (FIG. 4). The grooves 44 are for receiving one or more partitions 60 to allow a user to divide the main compartment 40 into separate work or storage areas (FIG. 6). Referring to FIG. 6, the partition 60 nests into the depression 46 in the floor of the main compartment 40. The partitions 60 is discussed in greater detail with reference to FIGS. 4 and 6.

Also shown in FIG. 3, the lid 30 of the multi-purpose craft box 10 has a contoured top surface, forming multiple plateaus or steps 34. The steps 34 are arranged to correspond to the bottom 16 of the multi-purpose craft box 10 (FIG. 2) to facilitate stacking one box 10 on top of another (as shown in phantom in FIG. 4). When the lid 30 is turned over, as shown in FIG. 5, the stepped plateaus 34 fit snugly within the multi-purpose craft box 10 and provide a secure work surface. This work surface has a "roll-guard" edge to prevent tools and other items from sliding off. As shown in FIG. 6, the lid 30 "snaps" around the lip 18 which extends around the perimeter of the multi-purpose craft box 10. The lid 30 is further provided with opposing flaps 32 located, preferably, towards the center of the sides of the lid 30. These flaps 32 may be used to provide an additional means of securing the lid 30 to the multi-purpose craft box 10. Each flap 32 is located above the gripping handles 15 on the central top portion of each side wall 14. The gripping handles 15 may be used to carry the multi-purpose craft box 10 when the user is not supporting the multi-purpose craft box 10 against his or her hip.

FIG. 4 shows a preferred embodiment of the partition 60. The partition 60 is shaped to fit snugly between the opposing front wall 12 and the back wall 13 of the multi-purpose craft box 10. The bottom surface of the partition 60 has a raised central portion 61 to correspond to the raised floor 48 of the main compartment 40. At the center of the bottom surface of the partition 60, a curved flange 62 is provided to fit inside the bottom depression, thereby further securing the partition 60 within the main compartment 40. One or more partitions 60 may be inserted into the grooves 44. As shown, a D-shaped cut-out 63 serves as a handle for removing the partition 60 from the main compartment 30. Also, the partition 60 contains a plurality of circular cut-outs 64, preferably of different sizes. The circular cut-outs 64 each comprise an inner ring 65 at the end of a downward extending tab 66. The downward extending tab 66 is attached to the top portion 67 of the circular cut-out. A variety of objects, for example, tools, writing utensils, or paint brushes (shown as a pen 68 in FIGS. 4 and 6), may be suspended from the inner ring 65 within the circular cut-outs 64.

Figure 8:
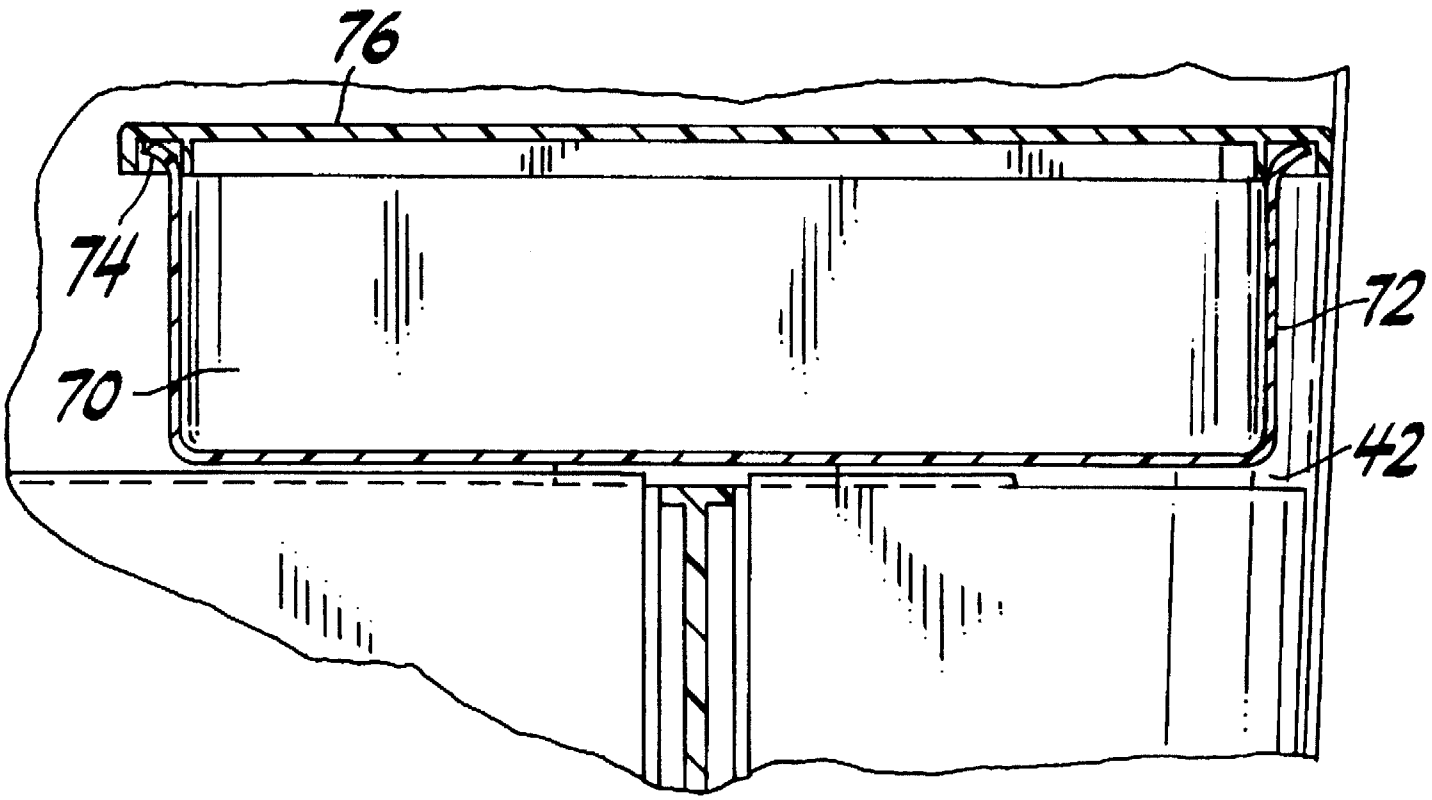
FIG. 8 is a sectional view taken along the line 8—8 of FIG. 3.

Once the partition 60 is inserted into the grooves 44, the top of the partition 60 is below the height of the ledge 42 forming the resting surface inside the main compartment 30 (FIG. 8). This allows a container 70, placed upon the ledge 42, to be positioned anywhere within the main compartment 40 by simply sliding the container to the desired location.

FIG. 8 illustrates a cross-sectional view of the container 70. The top surface of the side walls 72 of the container 70 curve outwards to form a lip 74. A snap-on cover 76 may be placed around the lip 74 of the container 70. Although the container is shown having a trapezoidal shape and a see-through plastic snap-on lid, these features are simply a matter of preference and are not critical to the invention. Any suitably size and shaped container may be used with the multi-purpose craft box 10. The only requirement is that the length of the container 70 must be sufficient to span the width of the main compartment 30 in order for the container to rest upon the resting surface. The height of the container 70 is chosen so that the container 70 will not interfere with the lid 50 when the lid 50 is inverted and used as a work surface.

Ideally, the craft box, including the lid, is molded from thermoplastic material via conventional molding techniques. This minimizes the cost of manufacturing while still maintaining the durable and lightweight qualities of the multi-purpose craft box 10. The partition 60 and the dividers 25 are similarly constructed from a thermoplastic material. The partitions 60 are fully interchangeable with each other, as are the dividers 25.

While the invention has been particularly shown and described with reference to a preferred embodiment thereof, it will be understood by those skilled in the art that various changes in form and details may be made therein without departing from the spirit and scope of the invention.

I claim:

1. A multi-purpose craft box, comprising:

a substantially rectangular box having a bottom surface, side walls, and convexly-curved front and back walls, said front, back and side walls surrounding a main compartment;

the inner surface of said front and back walls having a shoulder situated towards the top portion of each wall, so that a container may be supported thereupon;

at least one pair of grooves opposingly located in said shoulder on said front wall and on said back wall such that a partition may be inserted into a respective one of said pair of grooves to subdivide the main compartment;

a front tray extending outwards from the upper portion of said convexly-curved front wall; and a contoured lid for covering both said main compartment and said front tray.

2. The multi-purpose craft box of claim 1, further comprising at least one partition extending from said front wall to said back wall slidably mounted in a respective one of said at least one pair of grooves to subdivide the main compartment.

3. The multi-purpose craft box of claim 2, further comprising a plurality of said pairs of grooves such that each partition may be inserted into a respective one of a plurality of said pairs of grooves to subdivide the main compartment.

4. The multi-purpose craft box of claim 3, wherein each partition contains a plurality of cut-outs having a variety of shapes.

5. The multi-purpose craft box of claim 4, wherein each partition contains (1) a D-shaped cut-out located towards the top thereof, and serving as a handle, and (2) a plurality of circular cut-outs, each circular cut-out having an inner ring attached to a downward extending tab, such that an object may be suspended from said inner ring.

6. The multi-purpose craft box of claim 1 wherein said front tray is divided into first and second compartments separated by a shallow middle compartment.

7. The multi-purpose craft box of claim 6 wherein said first and second compartments contain slots for receiving dividers, thereby allowing said first and second compartments to be further subdivided.

8. The multi-purpose craft box of claim 1 wherein said contoured lid, when inverted, fits securely into the main compartment and over said front tray, so that said contoured lid serves as a work surface.

9. The multi-purpose craft box of claim 1 wherein the central portion of said bottom surface is indented correspondingly with said contoured lid, so that one multi-purpose craft box may be securely stacked upon another.

* * * * *